US006422454B1

(12) United States Patent
Barr et al.

(10) Patent No.: US 6,422,454 B1
(45) Date of Patent: Jul. 23, 2002

(54) FLIP-TOP PACKAGE FOR SHIPPING AND DISPLAY OF A MULTI-COMPONENT MEAL KIT

(75) Inventors: Christopher D. Barr, Grayslake; Neil Enciso, Chicago, both of IL (US)

(73) Assignee: Kraft Foods, Inc., Northfield, IL (US)

( * ) Notice: Subject to any disclaimer, the term of this patent is extended or adjusted under 35 U.S.C. 154(b) by 0 days.

(21) Appl. No.: 09/782,560

(22) Filed: Feb. 13, 2001

(51) Int. Cl.[7] ..... B65D 5/46; B65D 17/00

(52) U.S. Cl. ..... 229/117.14; 229/110; 229/243; 229/162; 229/904; 229/120.38

(58) Field of Search ..... 229/244, 225, 229/243, 120.38, 238, 108, 109, 110, 207, 117.14, 117.13, 162, 902, 904

(56) References Cited

U.S. PATENT DOCUMENTS

| | | | | |
|---|---|---|---|---|
| 2,104,195 A | | 1/1938 | Groeling | |
| 2,233,488 A | | 3/1941 | Powell | |
| 2,362,942 A | | 11/1944 | Spalding | |
| 2,368,864 A | | 2/1945 | Molet | |
| 2,822,118 A | * | 2/1958 | Will | 229/244 X |
| 3,241,737 A | | 3/1966 | Steinbock | |
| 3,246,829 A | | 4/1966 | Sexton | |
| 3,322,265 A | * | 5/1967 | Collura | 229/162 X |
| 3,620,439 A | * | 11/1971 | Morse | 229/208 |
| 3,690,523 A | * | 9/1972 | Link | 229/117.18 |
| 3,773,248 A | * | 11/1973 | Cecil et al. | 229/207 |
| 3,799,424 A | | 3/1974 | Mayea | |
| 3,951,333 A | * | 4/1976 | Forbes, Jr. et al. | 229/207 |
| 3,976,241 A | | 8/1976 | Bemiss | |
| 4,235,158 A | * | 11/1980 | Johnson, Jr. | 229/120.38 |
| 4,252,236 A | | 2/1981 | Roccaforte | |
| 4,256,223 A | | 3/1981 | Pawlowski | |
| 4,518,115 A | | 5/1985 | Sedwick | |
| 4,700,831 A | | 10/1987 | Kassai | |
| 4,801,079 A | | 1/1989 | Gonella | |
| 4,865,203 A | * | 9/1989 | Ueda | 229/225 |
| D307,719 S | | 5/1990 | Band | |
| 5,005,701 A | | 4/1991 | Dutcher | |
| 5,143,431 A | | 9/1992 | Udell | |
| 5,186,384 A | | 2/1993 | Nelson | |
| 5,209,393 A | | 5/1993 | Xapelli | |
| 5,248,081 A | | 9/1993 | Hook | |
| 5,314,114 A | | 5/1994 | Stone | |
| 5,350,062 A | * | 9/1994 | Takiguchi et al. | 229/207 X |
| 5,429,243 A | | 7/1995 | Woelk et al. | |
| 5,429,295 A | | 7/1995 | Levy | |
| 5,529,240 A | | 6/1996 | Harris | |
| 5,584,430 A | | 12/1996 | Mulry | |
| 5,634,556 A | | 6/1997 | Focke et al. | |
| 5,653,384 A | | 8/1997 | Shaikh | |
| 5,875,963 A | | 3/1999 | Stone et al. | |
| 6,053,402 A | * | 4/2000 | Thomas et al. | 229/162 X |
| 6,073,760 A | | 6/2000 | Roemer et al. | |

* cited by examiner

*Primary Examiner*—Lee Young
*Assistant Examiner*—Tri M. Mai
(74) *Attorney, Agent, or Firm*—Fitch, Even, Tabin & Flannery

(57) ABSTRACT

A packaging apparatus for shipping and display of multi-component food items, such as a dinner assembled from multi-components. Included is a carton having an interior for receiving the various components required. An internal divider member disposed within the carton cooperates with the carton to maintain a pre-selected order of the components within the container. The carton contains a flip-top feature, and preferably is provided with a window for viewing the carton contents. A pull-out door may also be provided as an auxiliary means of access to the carton interior.

17 Claims, 11 Drawing Sheets

FLIP-TOP PACKAGE FOR SHIPPING AND DISPLAY OF A MULTI-COMPONENT MEAL KIT

BACKGROUND OF THE INVENTION

1. Field of the Invention

The present invention pertains to packaging apparatus for shipping and display of food products, such as a meal kit made from multiple components.

2. Description Of The Related Art

This invention relates to cartons for transporting sensitive items such as food products being delivered to a consumer. More particularly, this invention relates to folding cartons which can be made from a blank formed of sheet material, such as paperboard.

Numerous examples of these types of cartons are known in the art. However, additional challenges arise when the same carton used for shipping displays more elaborate finished food product, as well as their internal components, and their directions for assembly and, if necessary, heating or cooking. Further, the carton may be called upon to contain a wide variety of components which are best served in different temperature ranges and, for convenience, are packaged together for subsequent re-organization by the consumer. It is desirable to maintain organization of the several components within the carton, as the components must be accessed several times, at different stages of meal preparation.

Preparation of a dinner from individually packaged components located within a common carton frequently require preliminary assembly and a subsequent brief storage to await further handling by the consumer. It is important in such instances that the package provide consistent and easy access, throughout various stages of meal preparation, as well as initial opening, and it is desirable in certain instances to provide a carton with multiple points of access to the carton interior.

Cartons have been proposed for shipping of edible products, including the association of several product units within a common carton. Oftentimes, such, cartons do not take into consideration the peculiar requirements associated with multi-component dinners and the like, where one or more food products are assembled from kit components. While single component, and especially prepared single course dinners, are more easily displayed, multi-component dinners constructed from kit components present a display challenge that is more demanding, due to the increased complexity of information which must be presented to a prospective purchaser. Distinctive useful features of packaging systems are continually being sought in order to gain consumer acceptance. It is desirable that the carton, wherever possible, provide pleasant associations to the consumers along with necessary directions, to add to the pleasurable experience associated with the dinner and its preparation.

SUMMARY OF THE INVENTION

The objective of the invention is to provide a packaging system for shipping and display of multi-component food products, such as dinners to be prepared from a multi-component kit.

Another objective of the invention is to provide packaging apparatus which can be simply and inexpensively formed using conventional materials, and it is further desirable, whenever possible, to provide packaging materials in a space-saving, knocked-down or folded configuration.

A further objective of the present invention is to provide packaging apparatus with internal dividers for organizing different components.

A further object of the present invention is to provide packaging apparatus of the above-described type which provides-an association with pleasant experiences, such as opening an oven door.

These and other objects of the present are provided in a packaging apparatus for shipping and display of a multi-component meal kit, comprising a carton defining a hollow interior and having major opposed front and rear walls, opposed sidewalls, a bottom wall and a top-wall; the carton top wall having a beveled portion adjacent the front wall including a tear strip extending between the sidewalls to form a flip top portion moveable to form a top opening for access to the carton interior; a front wall including a window for viewing contents in the carton interior; and an internal divider member within the carton to divide the carton interior, to support a plurality of meal kit components.

DETAILED DESCRIPTION OF THE PREFERRED EMBODIMENTS

Figure 2:
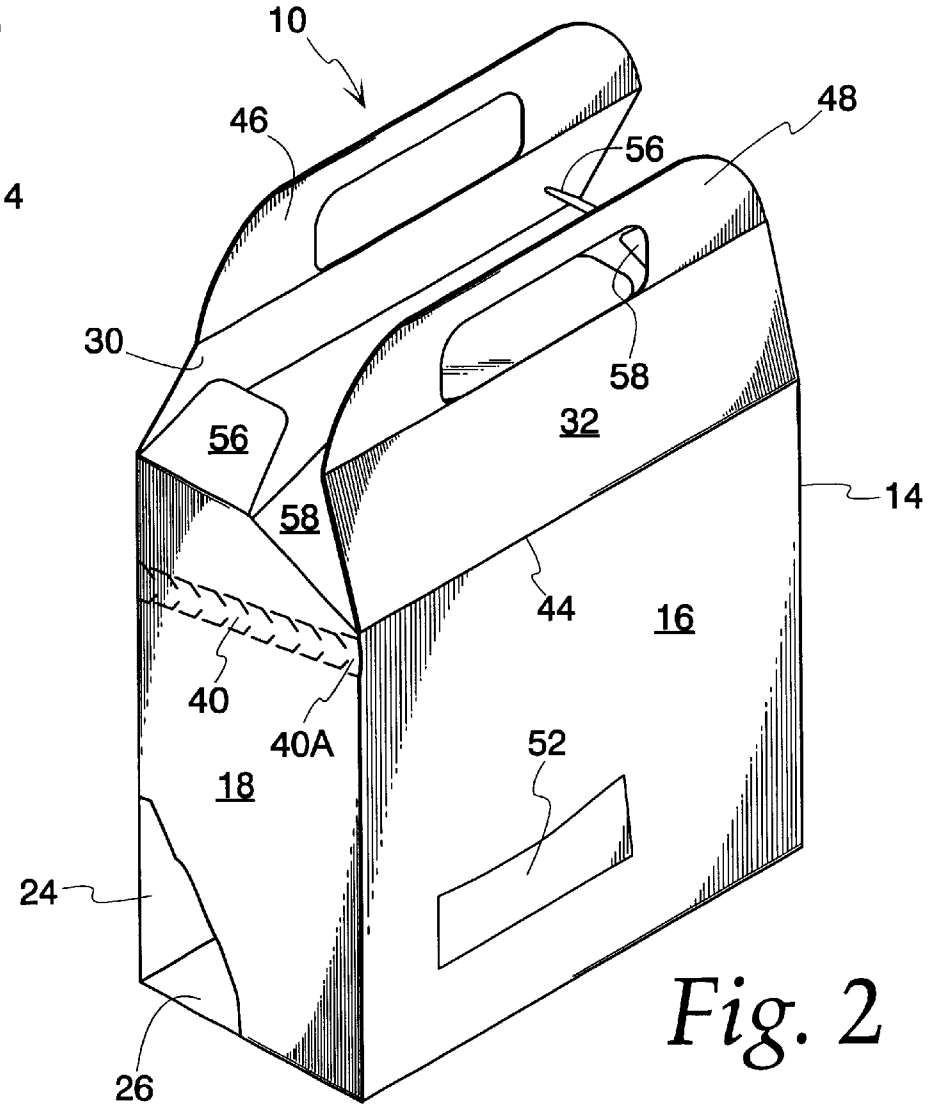
FIG. 2 is a perspective view thereof, shown partly broken away.

Referring now to the drawings, and initially to FIGS. 1–5, a meal kit package according to principles of the present invention is generally indicated at 10. Package 10 has found immediate commercial acceptance in the field of food products, and in a particular to meal servings formed from a variety of food products which may include partially prepared or fully prepared food items to be combined to form a meal serving.

For example, packaging items within package 10 could include food portions for preparing Chicken Alfredo. Packages within carton 10 could include, for example, Fettuccine pasta, Alfredo sauce, shredded mozzarella cheese and Parmesan herb topping. These ingredients form a meal kit which can be assembled as-is or combined with external food components such as chicken portions and an optional vegetable, such as peas.

The food items contained within package 10 are preferably individually packaged in pouches or other conventional containers known today. Upon delivery to a consumer, the separate items are removed from package 10 and are opened and combined in a baking dish which is then heated in an oven for a prescribed amount of time. The combined food items in the baking dish, upon cooking, form a complete, ready to eat meal.

Other food items can be disposed within package 10, including food items such as salsa or tortilla chips which do not require cooking. In addition, packaging items included within package 10 may include one or more beverages in conventional containers such as aluminum cans or leak-proof bags sometimes referred to as "soft packs". Package 10 could also be used with a variety of other commercially important products and need not be limited to meal kit items.

Package 10 includes an outer container 14 preferably made of paperboard material and most preferably formed from a unitary monolithic blank. For example, container 14 is constructed from a integral paperboard blank which is cut, scored and folded in conventional automated equipment to form a multi-sided enclosure which includes a front wall 16, side walls 18, 20 (see FIGS. 1 and 4), a rear wall 24 (see FIG. 5), a floor 26 (see FIG. 2), a first upper wall 30 and a beveled upper wall 32. In the preferred embodiment, side wall 18 is joined to front wall 16 with a manufacturers joint which includes flap 36 integrally formed with front wall 16. As shown in the figures, a tear strip 40 extends across back wall 24 (see FIG. 5) as well as side walls 18, 20 (see FIGS. 1 and 4, respectively). The user grasps one end of a tear strip (preferably located adjacent front wall 16) and removes the tear strip from package 10. Upper portions of side walls 18, 20, rear wall 24 and upper walls 30, 32 form a unitary lid or flip, top member swingable about hinge line 44, located at the juncture of front wall 16 and beveled wall 32. As indicated in FIG. 2, top wall 30 and beveled wall 32 each include upstanding handle members 46, 48 (see FIG. 2) which preferably are joined together with a suitable adhesive at the time of the assembly of carton 10.

Figure 1:
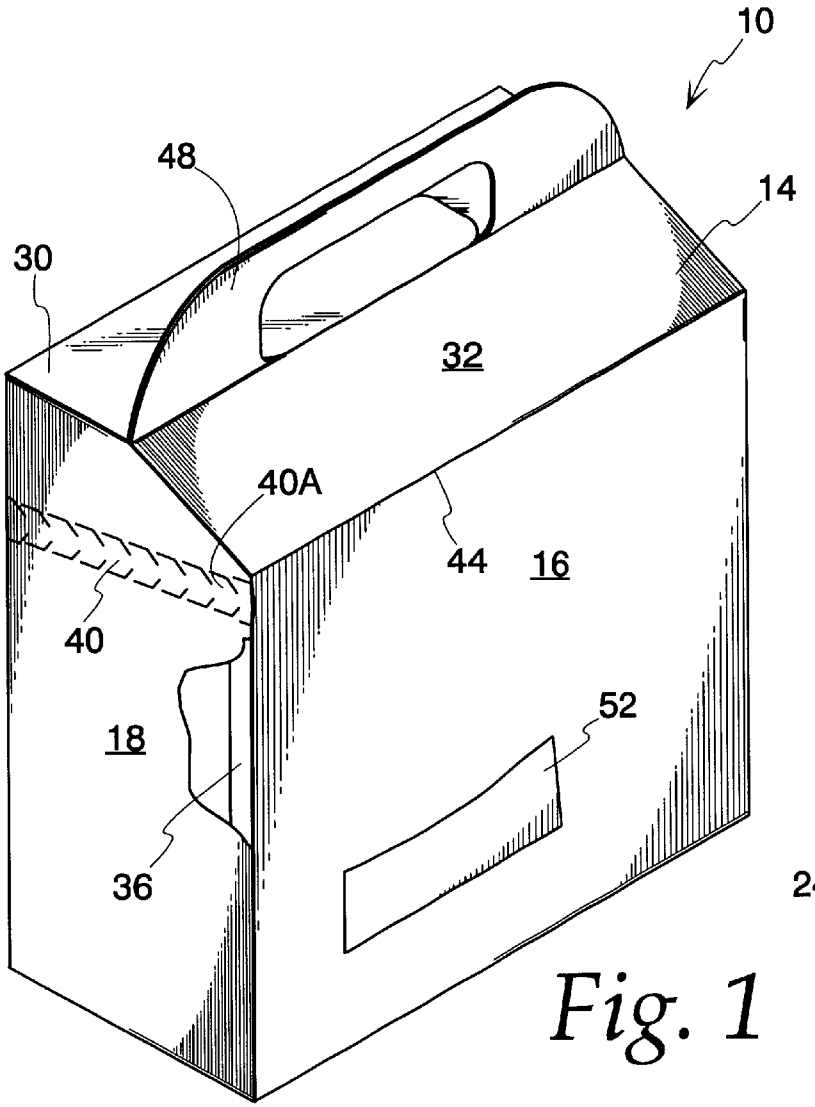
FIG. 1 is a perspective view of a package according to principles of the present invention.
Figure 5:
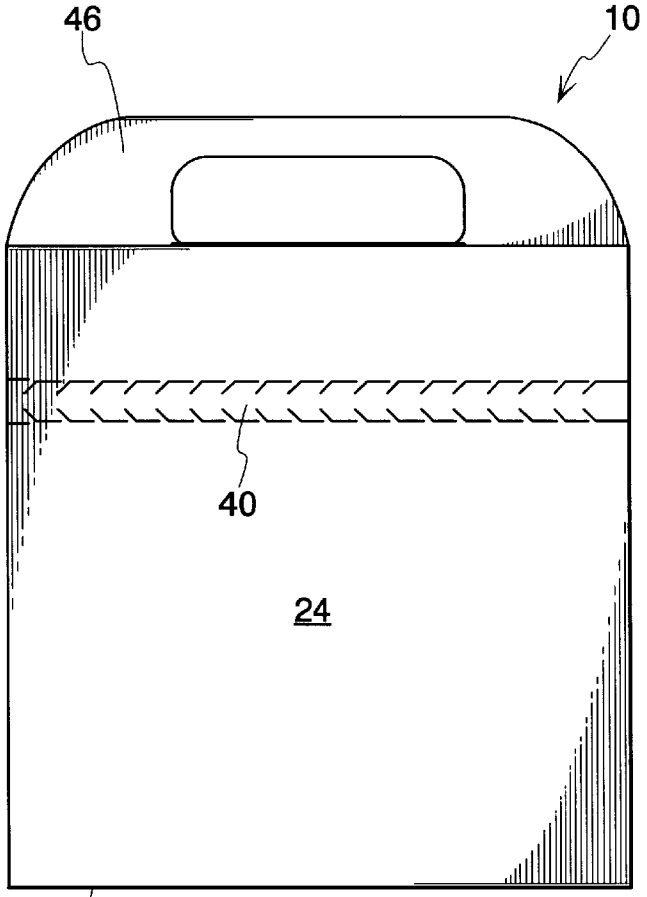
FIG. 5 is a rear elevational view thereof.

As can be seen in FIG. 1, package 10 includes a fixed window 52 formed in front wall 16, using conventional construction techniques. The window 52 may be left open, formed by a die cut of the carton blank or it may be covered with a transparent film. As will be seen below with reference to FIG. 13, a pull-drawer may be added to the carton front wall to provide a convenient access to the package interior.

FIG. 2 shows carton 14 in a partially assembled condition, revealing interior flaps with 56, 58 extending from upper portions of side walls 18, 20 for adhesive securement to top wall 30 and beveled wall 32, respectively. Preferably, carton 14 is fully formed with respect to its front, back, side and bottom walls prior to filling through its unfinished top portion. The construction of carton 14 offers advantages to a manufacturer, allowing filling of the carton using conventional high volume top-filling equipment and techniques proven in the industry to provide economical cost savings advantages. After filling, suitable adhesive is applied to handle portions 46, 48 and flaps 55, 58 to form a permanently assembled top portion as shown in FIGS. 1–5.

Figure 4:
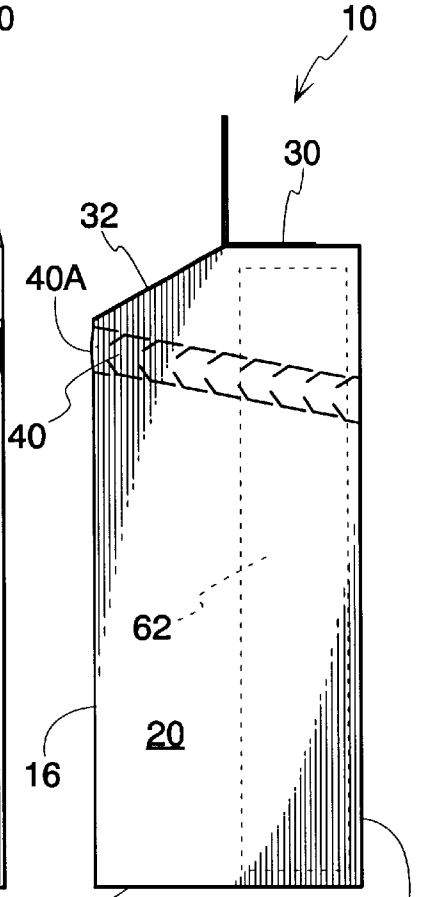
FIG. 4 is a side elevational view thereof.
Figure 3:
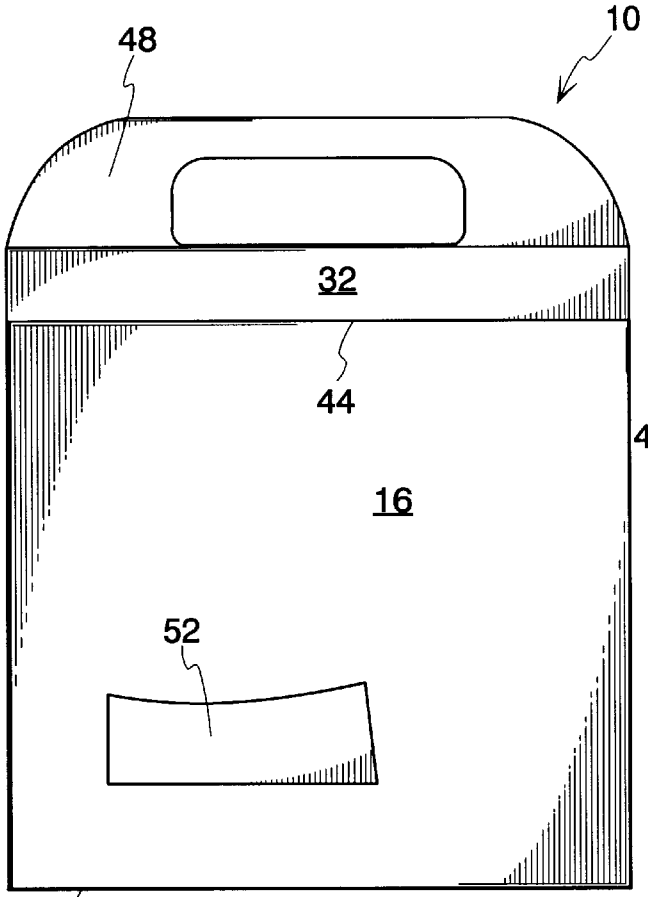
FIG. 3 is a front elevational view of the package of FIG. 1.

As can be seen in FIGS. 1 and 4, for example, top wall 30 is preferably formed at a generally right angle to back wall 24 while beveled wall 32 is downwardly inclined, lying in a plane which is angularly offset from that of top wall 30. Several advantages are obtained with this construction. For example, as can be seen with reference to FIG. 4, an enlarged opening is presented to the user in front of handle portion 48, making it easier for insertion of a users fingers and providing a predefined orientation feature adjacent the front wall 16 of the carton which may be appropriately decorated in an attractive, prominent manner.

As will be seen with reference to FIGS. 6–11, package 14 includes inserts for arranging packaging items in an upright position and for separating the packaging items during shipment. As a further advantage, upright packaging items (schematically indicated by reference numeral 62 in FIG. 4) can be made with relatively small cross-sectional dimensions compared to the lateral dimensions of the carton and still be constrained during shipping to avoid damage (as would otherwise occur were the packaging item allowed a greater freedom of movement). This feature would allow, for example, tube-like small cross section flexible packages to extend the entire height of carton 14. These shapes are convenient for dispensing sauces or other liquids which heretofore have required a larger, more stable packaging shape and/or a heavier, more rigid packaging material. Referring again to FIG. 4, if additional securement of packaging item 62 is desired, the packaging items can be made to have a shape and size generally corresponding to that of side wall 20. In this manner, the packaging item can be made to have a shape for keying close fit cooperation with carton 14 to provide further securement of the packaging item. The packaging item 62 will accordingly have both top wall and doubled wall portions to provide the keying shape.

Referring again to FIGS. 1–5 tear strip 40 extends across side walls 18, 20 at an angle, while the same tear strip extends across back wall 24 in a "flat" or horizontal direction. Most preferably, tear strip 40 extends downwardly away from front wall 16 with the free ends 40A of the tear strip being oriented along a. predefined downwardly inclined angle. This arrangement provides a number of advantages. For example, it has been found that consumers typically open package 14 while holding the package at table height, a substantial distance below eye level, a vantage point from which it is difficult to accurately perceive a horizontal direction.

With reference to FIG. 4, that portion of tear strip 40 grasped and initially torn by a consumer lies generally along the consumers downwardly inclined line of sight and accordingly an accurate initial tearing is intuitively achieved by the consumer. Once tearing of strip 40 is initiated and continued to back wall 24, a consumer will typically face back wall 24 for the horizontal tearing operation. The consumer may thereafter continue tearing along the opposed side wall or may grasp the free end of the tear strip located on the opposed side wall, so as to meet at the rear corner of carton 14. Increasingly, consumers have come to expect helpful information such as serving suggestions, cooking directions and recommended recipe alternatives conveniently displayed on the outer surface of the package. An accurate, confined tearing of strip 40 is important if indicia on the outside of carton 14 is to remain intact for reference by a consumer after the package is opened.

Although a preferred orientation of carton 14 has been described above, the relative orientation may be readily changed, if desired. For example, wall 24 can be made the front wall or prominent wall of package 10 and the relative angular positioning of top walls 30, 32 can be altered if desired to form a gable top or other arrangement, for example.

Figure 7:
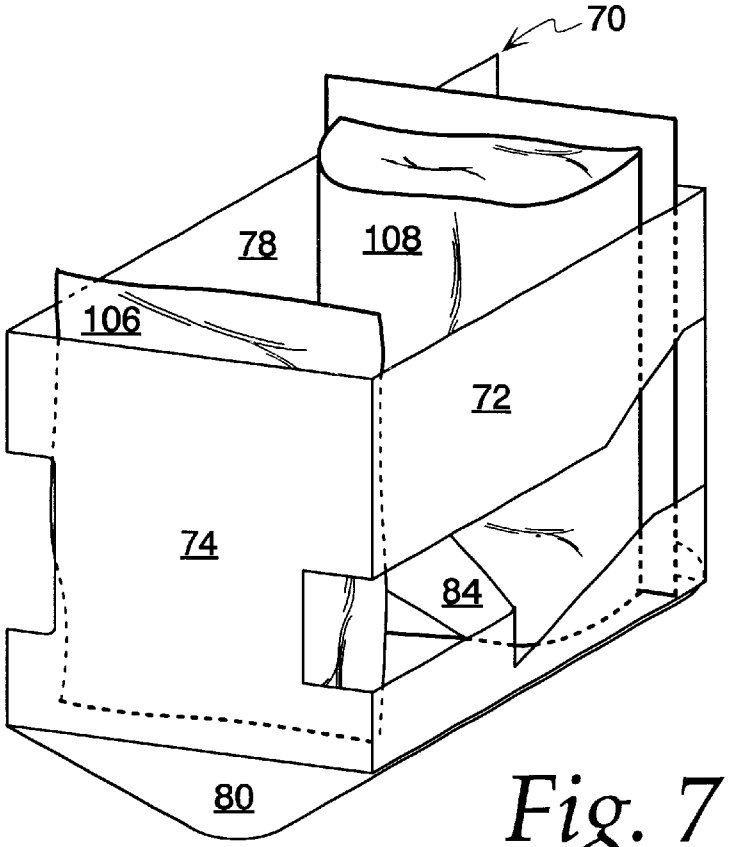
FIG. 7 is a perspective view of the insert of FIG. 6, shown in combination with packaging items.
Figure 6:
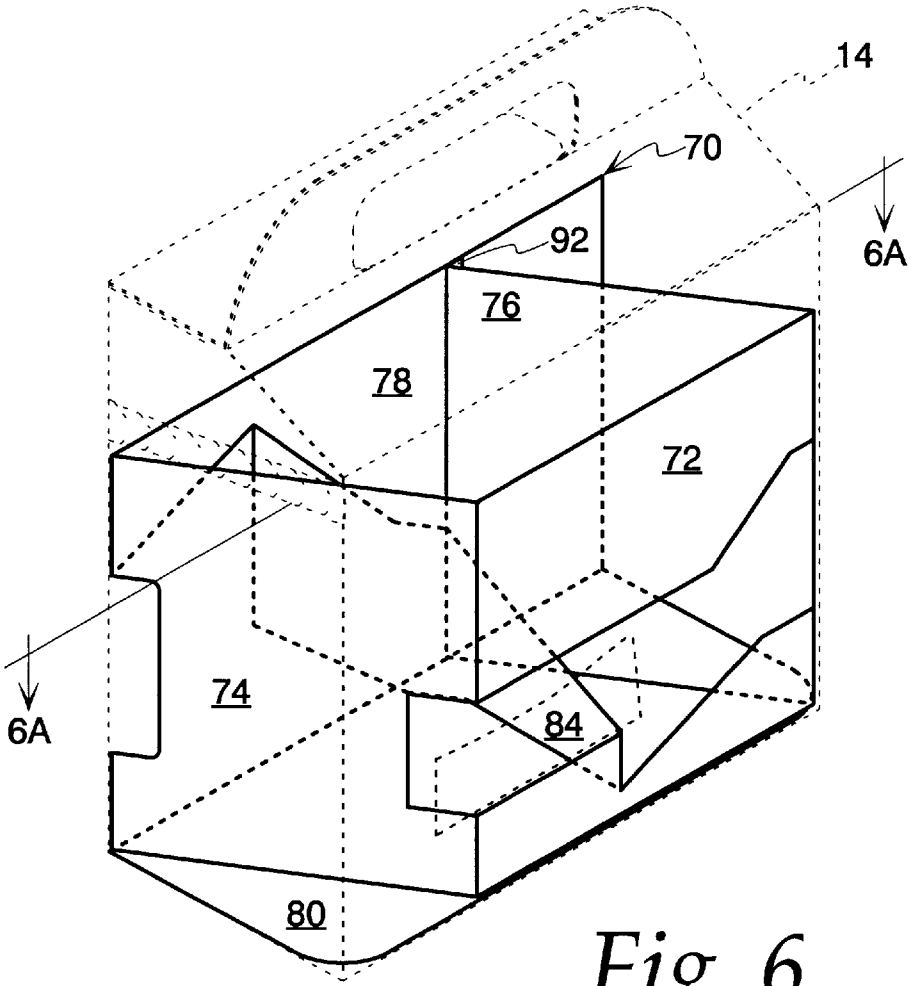
FIG. 6 is a perspective view of an insert for use therewith.
Figure 8:
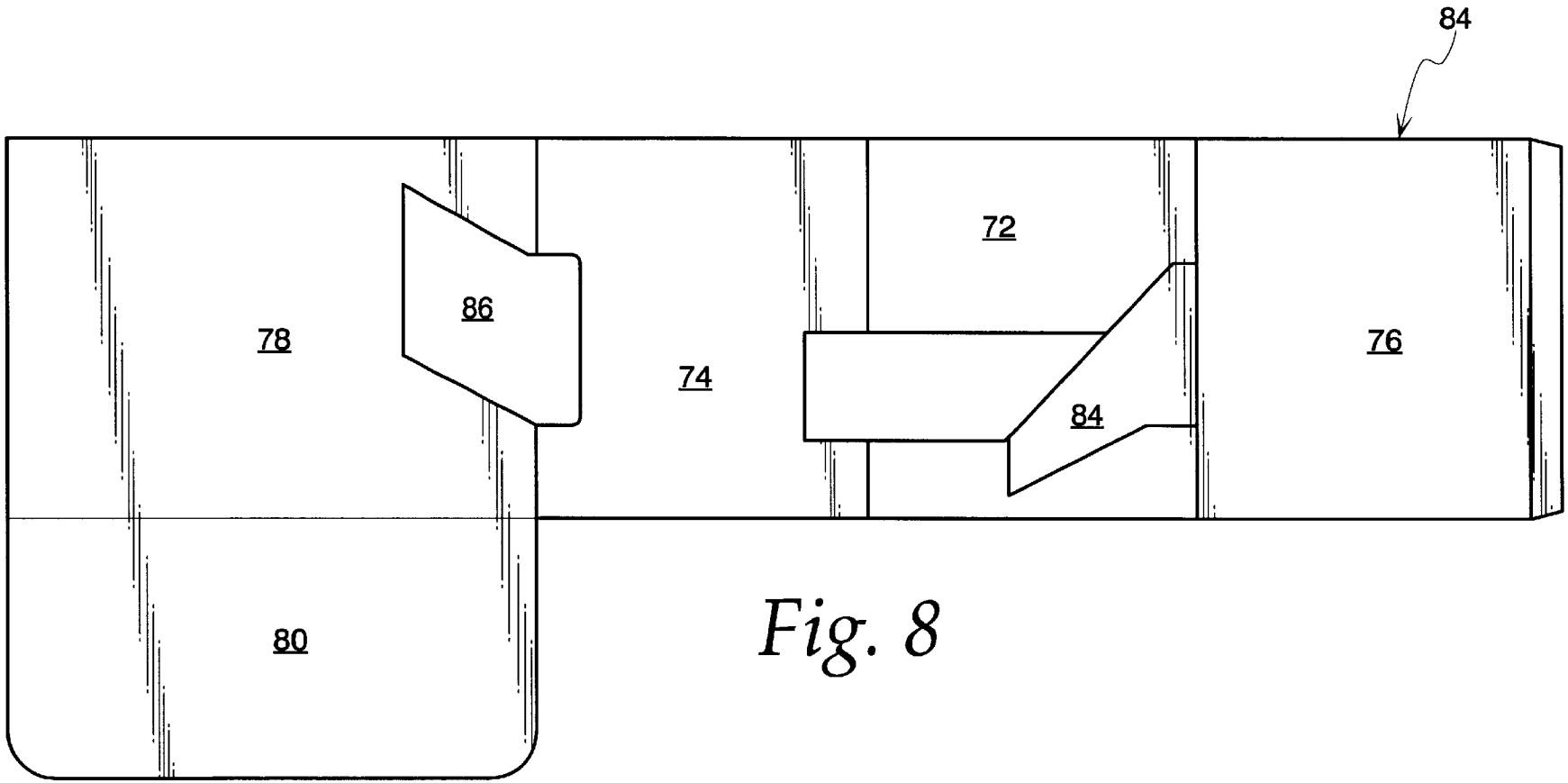
FIG. 8 is a top plan view of a blank from which the insert of FIG. 6 is constructed.

Referring now to FIGS. 6–11 and initially to FIGS. 6–8 inserts are provided for package 10. Preferably, the inserts are telescopically inserted through the open top of carton 14 prior to filling. The inserts are constructed such that they need not be adhesively secured to the carton interior, unless desired by the manufacturer.

Figure 6B:
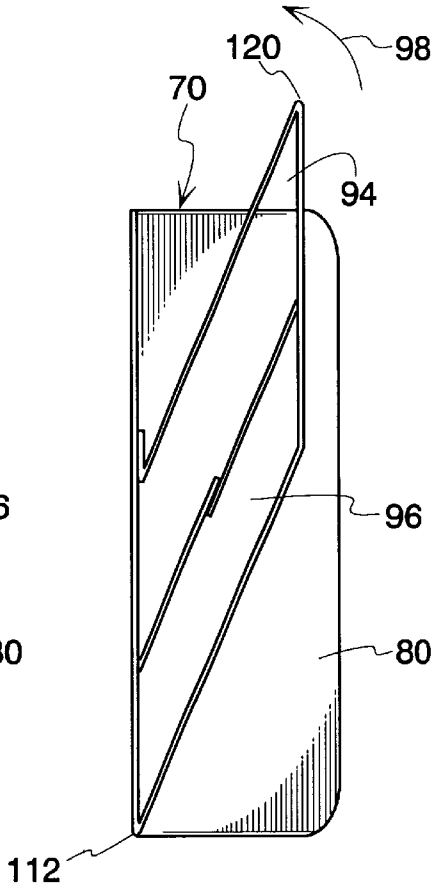
FIG. 6B is a cross-sectional view similar to that of 6A but with the insert in a partially collapsed position.
Figure 6A:
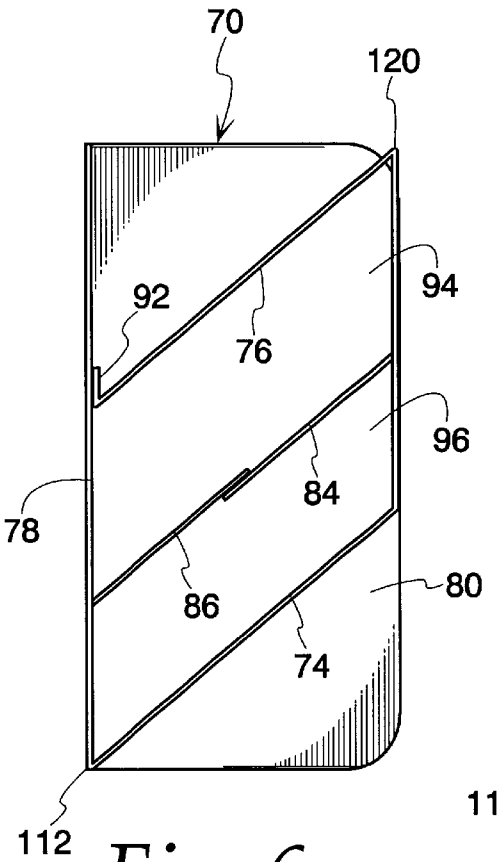
FIG. 6A is a cross-sectional view taken along the line 6A—6A of FIG. 6.

Referring now to FIGS. 6–8, an insert generally indicated at 70 includes a front wall 72, side walls 74, 76, a rear wall 78 and a bottom wall 80 although not required, insert 70 is preferably constructed from a unitary monolithic blank 84 shown in FIG. 8. Insert 70 is preferably made of paperboard material but may also be formed of other conventional materials, such as plastic or laminated composites. Also included in insert 70 is a divider wall formed by joining strips 84 extending from front wall 72 and strip 86 extending from back wall 78. As shown in FIG. 6A, strips 84, 86 are partially overlapped, and are joined together with a suitable adhesive. Side wall 74, front wall 72 and side wall 76 form an integral extension of back wall 78. The free end 92 of side wall 76 (see FIG. 6A) is joined to back wall 78 with suitable adhesive. Referring to FIGS. 6A and 6B, insert 70, as seen from above, forms openings 94, 96 defined by a flexible multi-cell or parallelogram structure which preferably remains unattached to bottom wall 80 so as to allow collapsing when forced along arrow 98 (see FIG. 6B).

Figure 15:
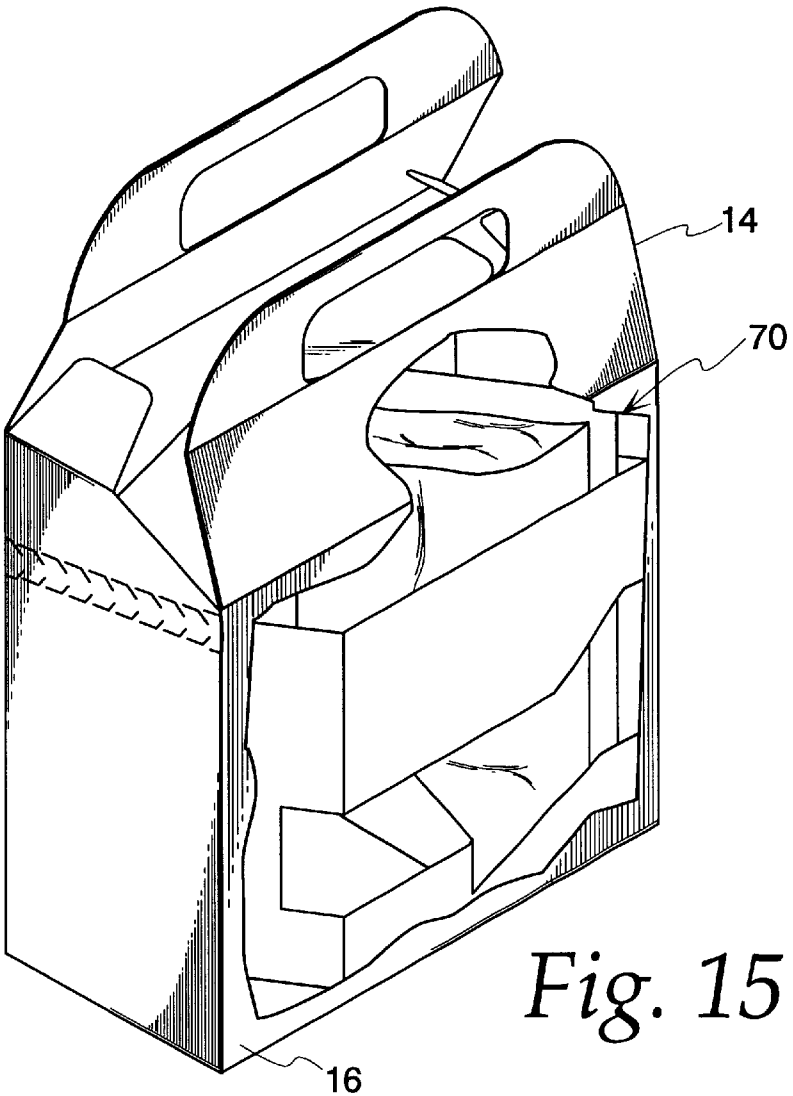
FIG. 15 shows the package of FIG. 14 partially broken away to show the insert of FIG. 6 inserted therein.

One advantage of insert 70 is that it may be fully collapsed to form a space-efficient flat package which may be pre-assembled off site for transport to a product manufacturer. The collapsed insert may be quickly and easily erected using automated equipment if desired so as to be readily inserted within the interior of carton 14. Preferably, bottom wall 80 of the insert is closely dimensioned with respect to bottom wall 26 of carton 14 and is shaped such that the corner 102 of the insert contacts the carton corner at the juncture of front wall 16 and side wall 20 so as to maintain the insert in the fully expanded configuration shown in FIGS. 6A and 7. Referring to FIG. 15, a front wall 16 of carton 14 is shown broken away to reveal insert 70.

Referring to FIG. 7, packaging items such as flexible food packages 106, 108 are stored in an erect, upright position and for example may be maintained out of contact with one another to prevent crushing of the package's contents (e.g. potato chips or the like).

With reference to FIGS. 6 and 7, bottom wall 80 of insert 70 provides additional support at the bottom of the package. Accordingly, if desired, bottom wall 26 of the carton may be formed with a conventional folded pinwheel construction and need not comprise adhesively secured flaps, although such may be employed, if desired. If bottom wall of carton 14 is found to contain adequate. strength, bottom wall 80 of insert 70 may be eliminated, in which case the opposed corner 112 of the insert (see FIGS. 6A, 6B) can be relied upon to cooperate with corner 102 to maintain the insert walls in the desired fully expanded configuration.

Figure 9B:
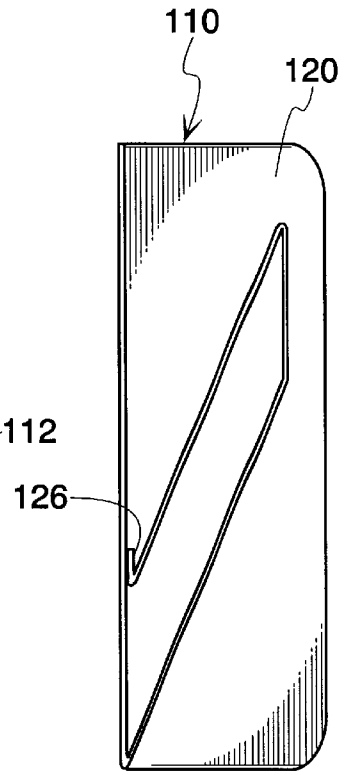
FIG. 9B is a cross-sectional view similar to that of FIG. 9A but showing the insert in a partially collapsed position.
Figure 9A:
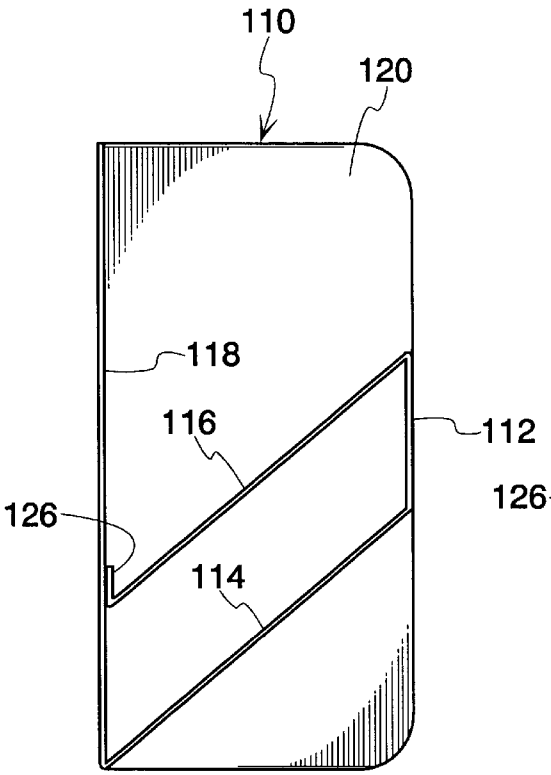
FIG 9A is a cross-sectional view taken along the view 9A—9A of FIG. 9.
Figure 10:
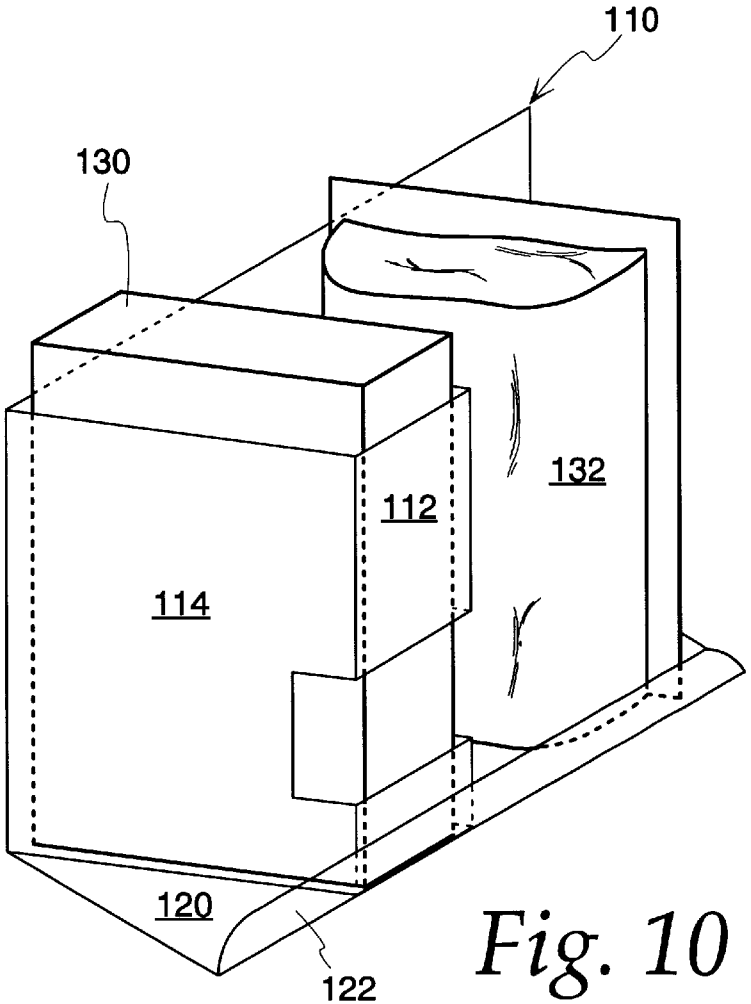
FIG. 10 is a perspective view showing the insert with packaging items.
Figure 9:
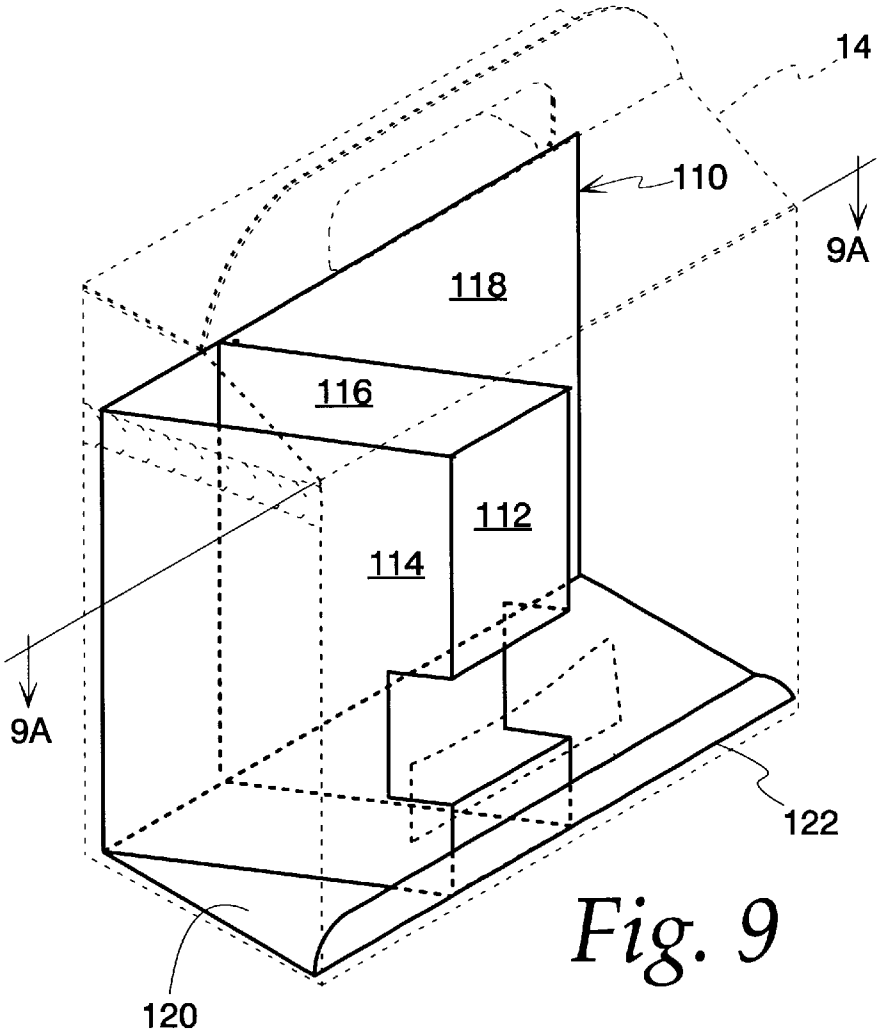
FIG. 9 is a perspective view of an alternative embodiment of an insert for use with the package of FIG. 1.
Figure 11:
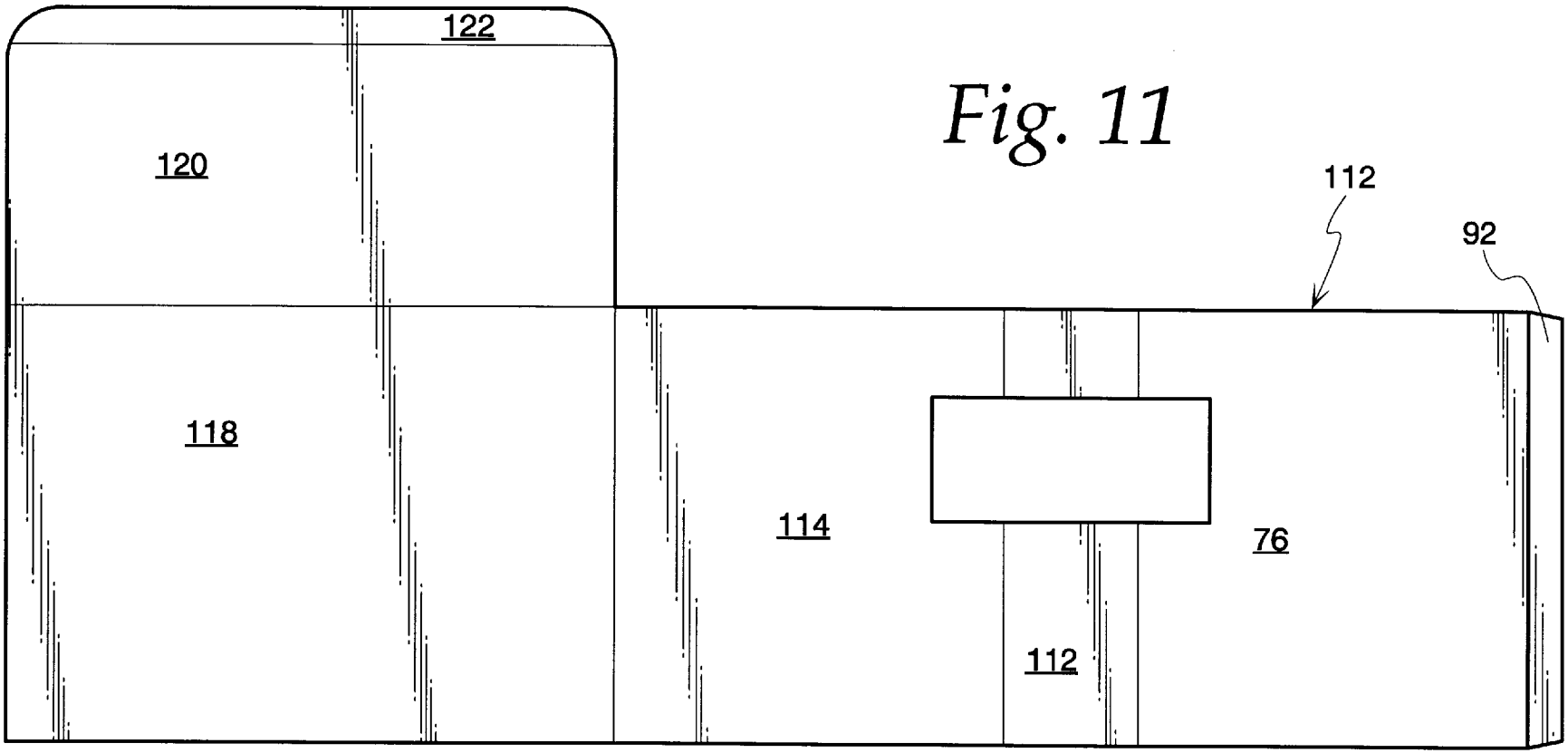
FIG. 11 is a plan view of a blank from which the insert of FIG. 9 is constructed.

Turning now to FIGS. 9–11, an alternative insert is generally indicated at 110. Insert 110 is also preferably made from an integral monolithic blank, such as the blank 112 shown in FIG. 11. Insert 110 includes a front wall 112, side walls 114, 116 and a rear wall 118. Also included in insert 110 is an optional bottom wall 120 and an upstanding flap 122.

As indicated for example in FIGS. 9A, 9B front wall 112 and sidewalls 114, 116 form integral extensions of rear wall 118. The free end 126 of side wall 116 is secured to rear wall 118 with a suitable adhesive. The walls of insert 110 cooperate to form a single cell collapsible parallelogram when viewed from above. FIG. 9B shows insert 110 in a partially collapsed position and if desired, the entire insert 110 can be fully collapsed to a flat package ready for shipment to an assembly site. As with the preceding insert, the insert 110 can be quickly and easily erected, made ready for telescopic insertion in the open end of a carton, such as carton 14 described above.

FIG. 10 shows packaging items 130, 132 maintained in a separated, preferably upright position. Insert 110 in addition to providing the desired orientation for the packaging items, may be relied upon to prevent contact of the packaging items which would cause crushing or distortion of the package contents. For example, as is well known, delicate, rigid food products such as potato chips or tortilla chips may become readily damaged if subjected to impact from a neighboring package item. Other food products are also susceptible to inadvertent contact. For example, soft dough contained in one packaging item may have its preformed configuration distorted upon prolonged contact with an adjacent relatively massive neighboring package item.

Figure 13:
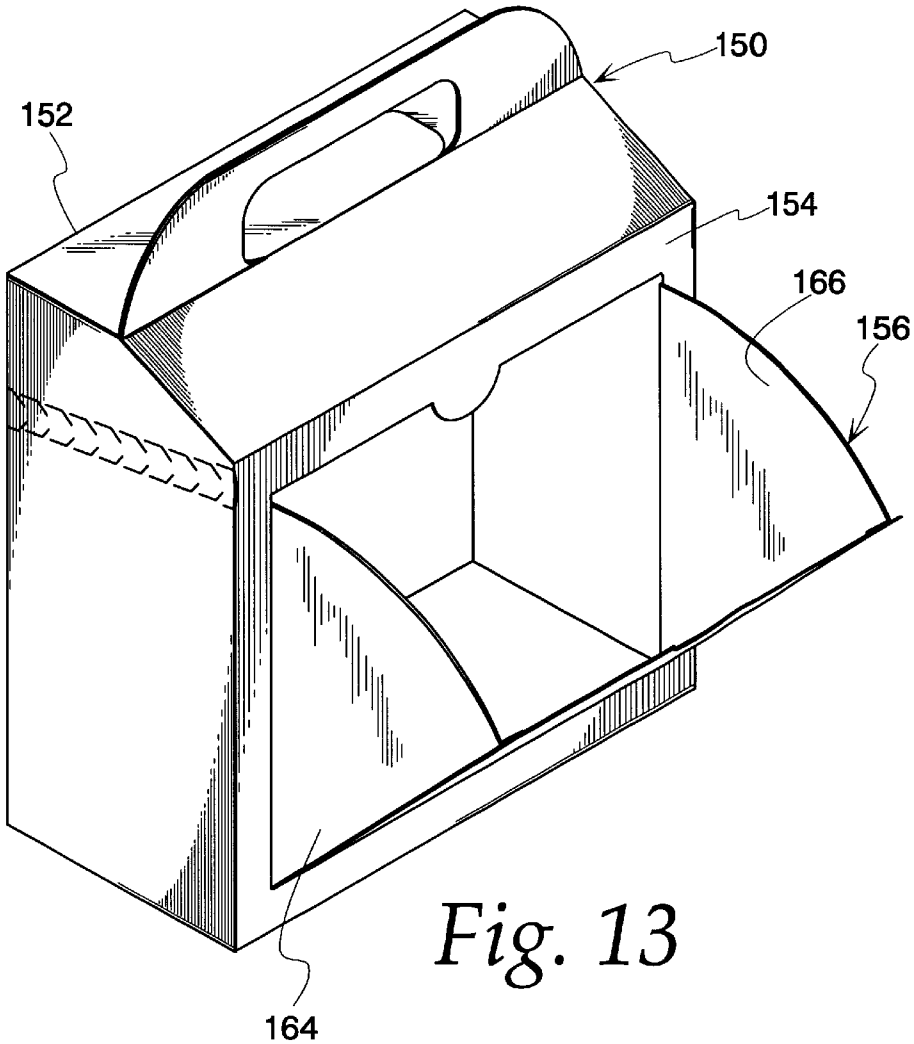
FIGS. 12 and 13 are perspective views of an alternative embodiment of the package according to principles of the present invention.
Figure 12:
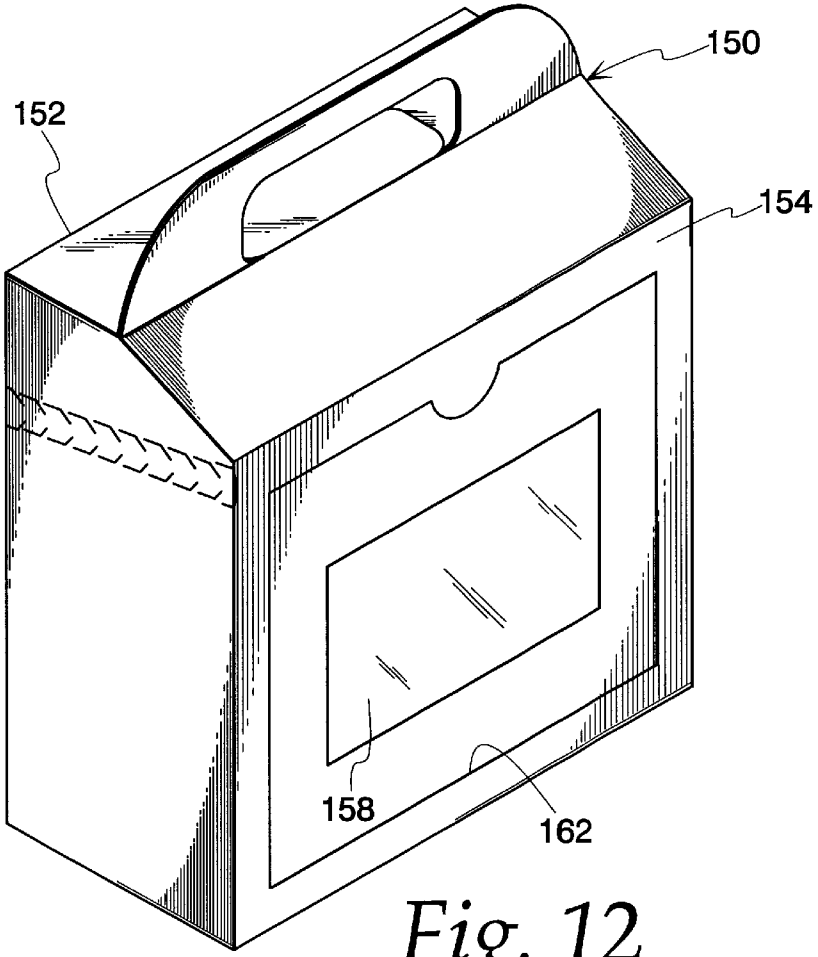

Referring now to FIGS. 12 and 13, an alternative embodiment of a package according to principles of the present invention is generally indicated at 150. Package 150 includes a carton 152 substantially identical to carton 14 described above except that its front wall 154 is formed to include a pull-out drawer generally indicated at 156. Pull-out drawer 156 contains an optional window 158 which may be modified or omitted, if desired. The pull-out drawer 156 is hingedly mounted at 162 to allow drawer sides 164, 166 to move past front wall 154, exposing the carton interior in the manner indicated in FIG. 13.

Figure 14:
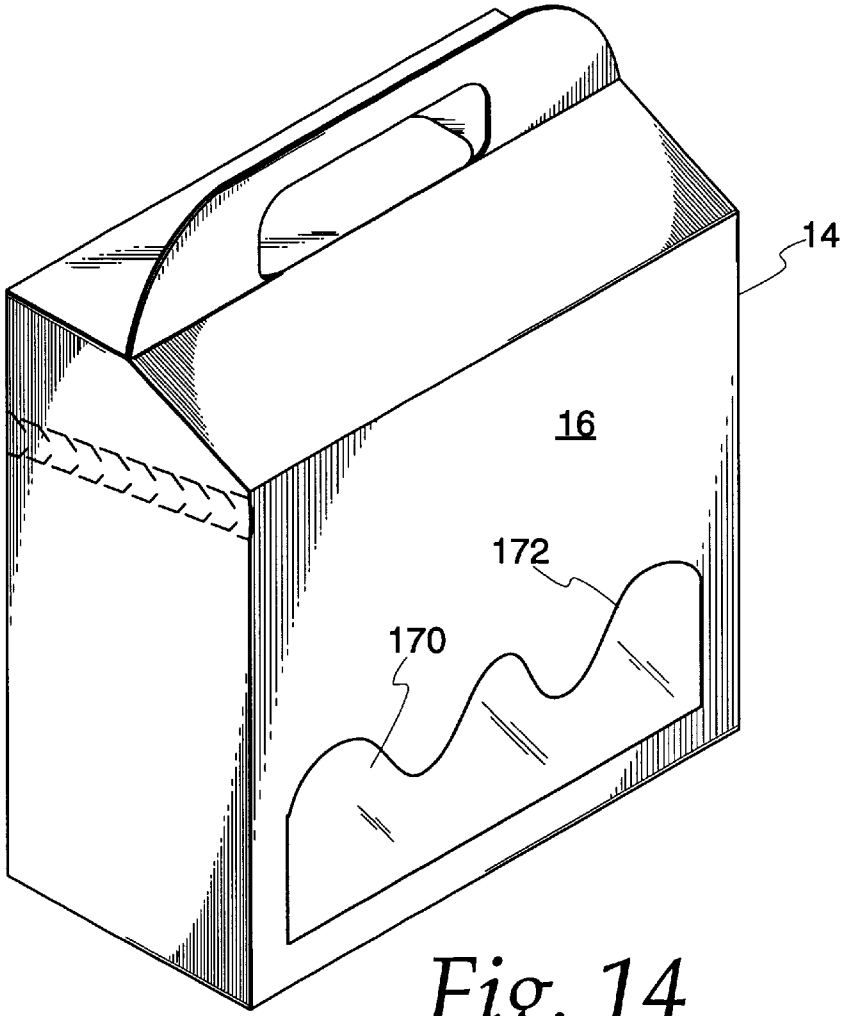
FIG. 14 is a perspective view of a further alternative embodiment of a package according to principles of the present invention.
Figure 16:
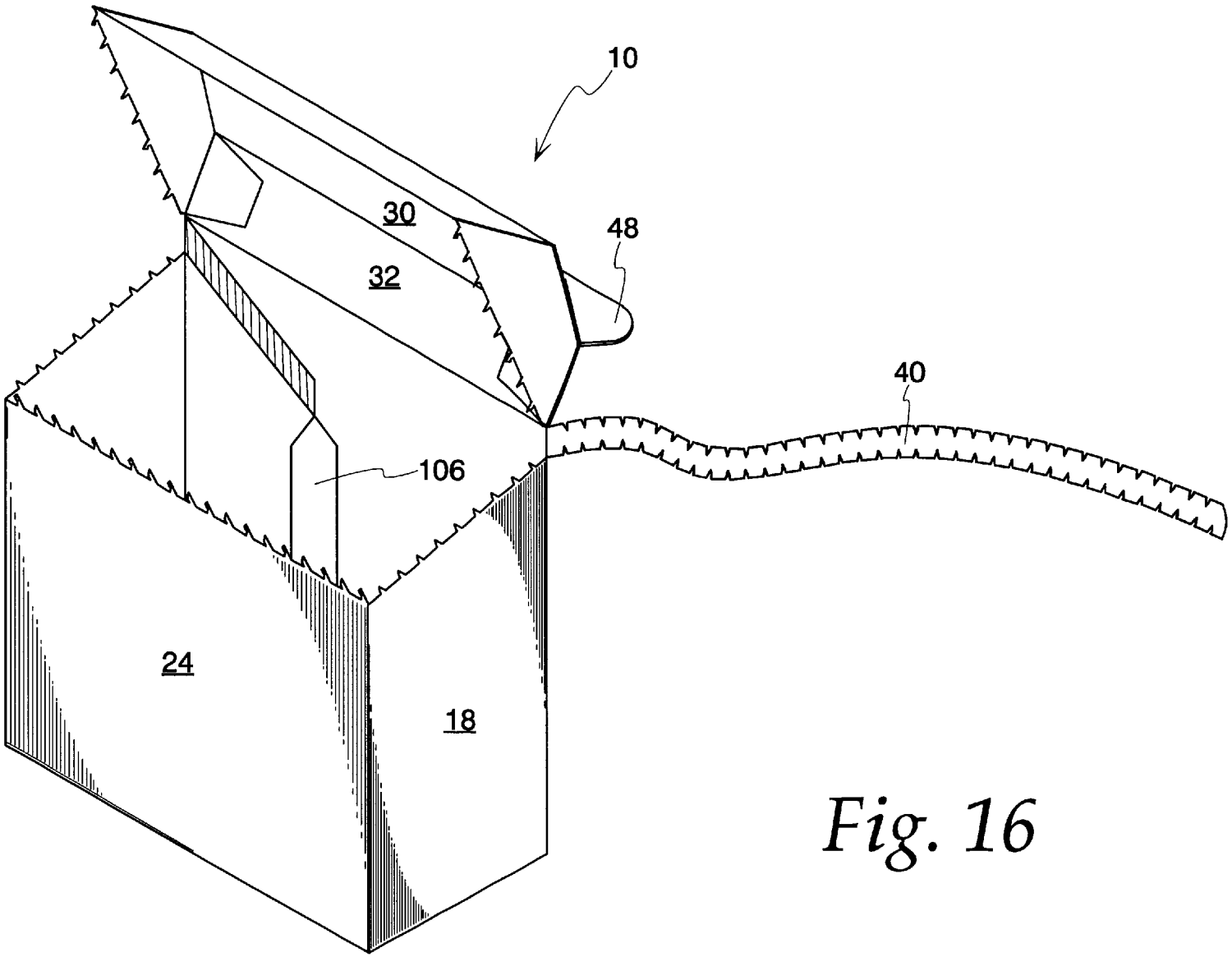
FIG. 16 is a perspective view showing the package of FIG. 1 being opened.
Figure 17:
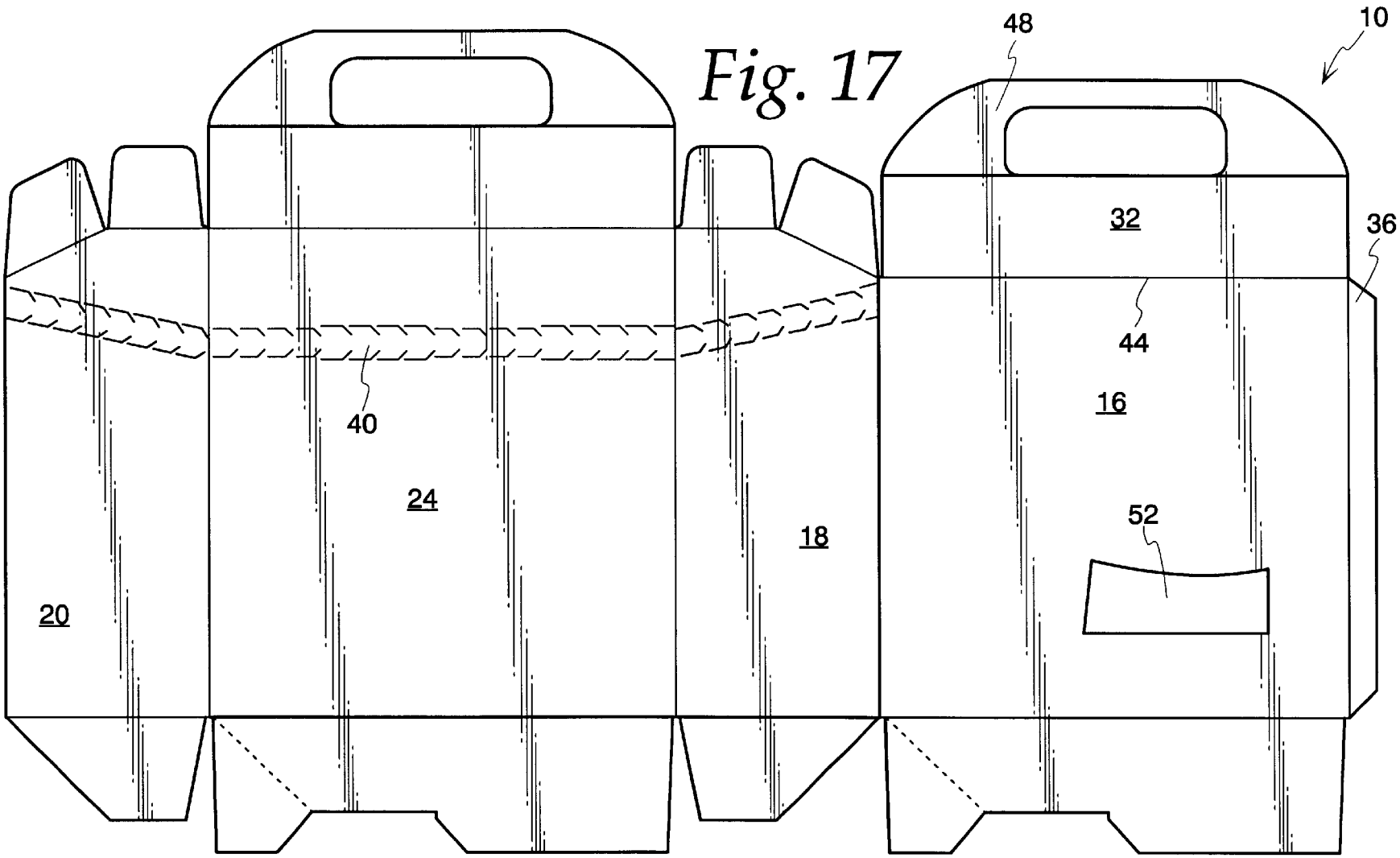
FIG. 17 is a plan view of the blank for the carton of FIG. 1.

The packaging carton described above may have a number of alternative features including windows of unusual shape. For example, as shown in FIG. 14, an optional window 170 may be formed in the front wall 16 of carton 14 with a serpentine upper edge 172. If desired, additional windows can be formed on the remaining walls of carton 14.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Packaging apparatus for shipping and display of a multi-component meal kit, having a carton and a divider member, the apparatus comprising:

a carton defining a hollow interior and having major opposed front and rear walls, opposed sidewalls, a bottom wall and a top wall;

the carton top wall having a beveled portion adjacent the front wall;

the carton including a tear strip extending between the sidewalls to form a flip-top portion moveable to form a top opening for access to the carton interior;

an internal divider member within the carton to divide the carton interior, to support a plurality of meal kit components;

said internal divider member including a backing part and a series of divider walls having spaced apart ends supported by said backing part to form at least one closed loop defining a component-receiving cavity;

said divider walls being flexibly moveable with respect to one another and with respect to said backing part so as to be collapsible against the backing part; and the carton front wall including a window for viewing contents in the carton interior.

2. The packaging apparatus of claim 1 wherein the internal divider member extends in a generally vertical direction for upright division of the carton interior.

3. The packaging apparatus of claim 1 further comprising a handle formed with said carton so as to extend the above said top wall.

4. The packaging apparatus of claim 3 wherein said handle lies between said top wall and said beveled wall and extends upwardly from said carton.

5. The packaging apparatus of claim 3 wherein said handle comprises overlapping member portions upwardly extending from said top wall and from said beveled wall.

6. The packaging apparatus of claim 5 wherein said top wall and said beveled wall are openable to form a top opening for top filling of said carton interior.

7. The packaging apparatus of claim 1 wherein, with said tear strip removed, said flip top portion is hingedly moveable about a hinge line adjacent said beveled portion.

8. The packaging apparatus of claim 7 wherein said hinge line extends between said beveled portion and said front wall.

9. The packaging apparatus of claim 1 wherein the carton is formed from a single monolithic blank.

10. The packaging apparatus of claim 9 wherein the blank is made of paperboard material.

11. The packaging apparatus of claim 1 wherein said internal divider member defines a single component-receiving cavity.

12. The packaging apparatus of claim 11 wherein said internal divider member defines a pair of component-receiving cavities, said internal divider member comprising a front wall spanning both cavities, with portions of said front wall and said backing part being cut out to extend toward one another in partly overlapping fashion.

13. The packaging apparatus of claim 1 wherein said tear strip includes end portions extending from the front wall that points generally adjacent the beveled wall.

14. The packaging apparatus of claim 13 wherein said tear strip end portions extend at an acute angle with respect to said beveled wall.

15. The packaging apparatus of claim 14 wherein, said tear strips extend at a non-normal angle with respect to said front wall, extending downwardly and rearwardly from said front wall.

16. The packaging apparatus of claim 1 wherein the divider member is formed from a single monolithic blank.

17. Packaging apparatus for shipping and display of a multi-component meal kit, having a carton and a divider member, the apparatus comprising:

a carton defining a hollow interior and having major opposed front and rear walls, opposed sidewalls, a bottom wall and a top wall;

said divider member comprising an internal divider member within the carton to divide the carton interior, to support a plurality of meal kit components;

said internal divider member including a backing part and a series of divider walls having spaced apart ends supported by said backing part to form at least one closed loop defining a component-receiving cavity;

said divider walls being flexibly moveable with respect to one another and with respect to said backing part so as to be collapsible against the backing part; and the carton front wall including a window for viewing contents in the carton interior.

* * * * *

UNITED STATES PATENT AND TRADEMARK OFFICE

CERTIFICATE OF CORRECTION

PATENT NO. : 6,422,454 B1
DATED : July 23, 2002
INVENTOR(S) : Christopher D. Barr et al.

It is certified that error appears in the above-identified patent and that said Letters Patent is hereby corrected as shown below:

Title page,
Item [73], change "Kraft Foods, Inc." to -- Kraft Foods Holdings, Inc. --

Signed and Sealed this

Eighteenth Day of February, 2003

JAMES E. ROGAN
*Director of the United States Patent and Trademark Office*